United States Patent [19]

Kondo et al.

[11] 4,448,869

[45] May 15, 1984

[54] PHOTOCONDUCTIVE COMPOSITION AND ELECTROPHOTOGRAPHIC LIGHT-SENSITIVE MATERIAL USING SAID COMPOSITION

[75] Inventors: Syun-ichi Kondo; Kenji Sano; Hideo Sato, all of Saitama, Japan

[73] Assignee: Fuji Photo Film Co., Ltd., Kanagawa, Japan

[21] Appl. No.: 472,305

[22] Filed: Mar. 4, 1983

[30] Foreign Application Priority Data

Mar. 4, 1982 [JP] Japan ..... 57-33082

[51] Int. Cl.[3] ..... G03G 5/05; G03G 5/09

[52] U.S. Cl. ..... 430/83; 430/81

[58] Field of Search ..... 430/83, 81; 252/501.1

[56] References Cited

U.S. PATENT DOCUMENTS 3,617,271 11/1971 Poot ..... 430/81

FOREIGN PATENT DOCUMENTS 28455 7/1974 Japan ..... 430/81

OTHER PUBLICATIONS

Hoegl, "On Photoelectric Effects in Polymers and their Sensitization by Dopants", The Journal of Physical Chemistry, vol. 69, No. 3, Mar. 1965, pp. 755–766.

*Primary Examiner*—Mary F. Downey

*Attorney, Agent, or Firm*—Sughrue, Mion, Zinn, Macpeak and Seas

[57] ABSTRACT

A photoconductive composition comprising an organic photoconductive substance and at least one compound represented by the general formula (I) or (II)

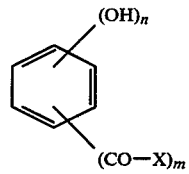

(I)

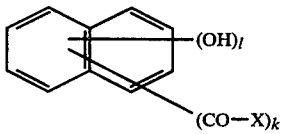

(II)

wherein X is an alkyl group, a substituted alkyl group, an aryl group, a substituted aryl group, an alkoxyl group, a substituted alkoxyl group, an aryloxyl group, or a substituted aryloxy group, n and m are each an integer of 1 or 2, and l and k are each an integer of from 1 to 4, and, optionally, a sensitizing dye capable of increasing the sensitivity of the organic photoconductive substance, and an electrophotographic light-sensitive material comprising a support having an electrically conductive surface and a layer of the photoconductive composition layer on the support. This electrophotographic light-sensitive material has sensitivity and superior stability with time.

19 Claims, No Drawings

PHOTOCONDUCTIVE COMPOSITION AND ELECTROPHOTOGRAPHIC LIGHT-SENSITIVE MATERIAL USING SAID COMPOSITION

FIELD OF THE INVENTION

The present invention relates to photoconductive compositions composed mainly of organic photoconductive substances, and electrophotographic light-sensitive materials bearing an electrophotographic light-sensitive layer which is made up of the composition. More particularly, the present invention relates to high sensitivity photoconductive compositions composed mainly of organic photoconductive substances and compounds represented by the general formula (I) or (II) as described hereinafter, and high sensitivity electrophotographic light-sensitive materials carrying an electrophotographic light-sensitive layer which is made up of the composition.

BACKGROUND OF THE INVENTION

As is well known, photoconductive substances for electrophotographic light-sensitive compositions include many organic compounds. Some of these organic compounds have been confirmed to have considerably high sensitivity. In fact, however, only a very limited number of organic photoconductive substances have been used in the preparation of electrophotographic materials.

Organic photoconductive substances have many superior properties compared with inorganic photoconductive substances, and therefore, may find many uses in the field of electrophotography. For example, transparent electrophotographic light-sensitive films, flexible electrophotographic light-sensitive films, those electrophotographic light-sensitive films which are light and easy to handle, and so forth can be prepared very advantageously using organic photoconductive substances. In addition, organic photoconductive substances have characteristics which could not be expected from the characteristics inorganic photoconductive substances e.g., film-forming properties during the production of electrophotographic light-sensitive materials, surface smoothness, and choice of the desired charging polarity in electrophotographic processes.

These organic photoconductive substances, however, have not yet been widely used in the field of electrophotography mainly because of their low sensitivity and poor film strength, although they have many excellent characteristics as described above.

Initially, low molecular heterocyclic compounds, nitrogen-containing aromatic compounds, various polymer type aromatic compounds, etc. have been extensively investigated as organic photoconductive substances. However, the sensitivity of these compounds must be increased to much higher levels, because even those organic photoconductive substances which are known to have the highest sensitivity do not have sufficient sensitivity to be put into practical use as such without the application of a sensitization treatment. For this reason, various sensitization methods have been studied. In the practical use of organic photoconductive substances, therefore, it is essential to select and employ a sensitization method which is most effective for them. It may safely by said that the industrial value of organic photoconductive substances is determined by the sensitization technique to be employed, i.e., by the increased sensitivity of the ultimate electrophotographic light-sensitive material which is achieved by application of the sensitization technique.

Addition of Lewis acids is such a sensitization method. In this method, sensitization is achieved by the appearance of a new spectral sensitivity resulting from the formation of a donor/acceptor complex between Lewis acids and organic photoconductive substances.

All the systems comprising organic photoconductive substances, sensitizing dyes, and heretofore known Lewis acids have poor stability with the lapse of time and are not suitable for practical use.

SUMMARY OF THE INVENTION

An object of the invention is to provide photoconductive compositions which are highly sensitized, and have excellent stability with the lapse of time.

Another object of the invention is to provide electrophotographic light-sensitive materials which have high sensitivity and have excellent stability with the lapse of time.

It has now been found that addition of compounds represented by the general formula (I) or (II) as described hereinafter increases the light sensitivity of organic photoconductive substances and provides excellent stability with the lapse of time. Therefore, the above-described objects are achieved by using the compounds represented by the general formula (I) or (II).

The present invention provides as embodiments:

(1) a electrophotoconductive composition containing an organic photoconductive substance or substances and at least one compound represented by the general formula (I) or (II):

(I)

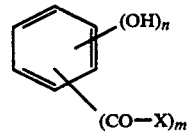

(II)

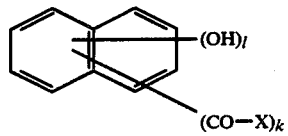

wherein X is an alkyl group, a substituted alkyl group an aryl group, a substituted aryl group, an alkoxyl group, a substituted alkoxyl group, an aryloxyl group, or a substituted aryloxyl group, n and m are each an integer of 1 or 2, and l and k are each an integer of from 1 to 4;

(2) a photoconductive composition containing an organic photoconductive substance or substances, at least one compound represented by the general formula (I) or (II) as described above, and a sensitizing dye or dyes capable of increasing the sensitivity of the organic photoconductive substance or substances;

(3) an electrophotographic light-sensitive material comprising a support having an electrically conductive surface, and a photoconductive composition layer on the support, the photoconductive composition containing an organic photoconductive substance or substances and at least one compound represented by the general formula (I) or (II) as described above; and (4) an electrophotographic light-sensitive material comprising a support having an electrically conductive surface, and a photoconductive composition layer on the support, the photoconductive composition containing an organic photoconductive substance or substances, at least one compound represented by the general formula (I) or (II) as described above, and a sensitizing dye or dyes capable of increasing the sensitivity of the organic photoconductive substance or substances.

DETAILED DESCRIPTION OF THE INVENTION

Various organic photoconductive substances can be used in the invention. Preferred are those substances which can be dye-sensitized. Typical photoconductive substances are given below:

(i) Polymeric organic photoconductive substances resulting from the polymerization of polycyclic aromatic or heterocyclic aromatic vinyl compounds containing $\pi$-electrons.

Typical examples of $\pi$-electron-containing nuclei constituting polymeric organic photoconductive substances include polycyclic aromatic hydrocarbon nuclei, e.g., naphthalene, anthracene, pyrene, perillene, acenaphthylene, phenylanthracene, and diphenylanthracene; heterocyclic aromatic compound nuclei, e.g., carbazole, indole, acridine, 2-phenylindole, and N-phenylcarbazole; and their halogen or lower alkyl-substituted derivatives. In the invention, vinyl polymers containing the above-described nuclei can be used as photoconductive substances. These vinyl polymers include vinyl polymers, such as polyvinyl naphthalene, polyvinyl anthracene, polyvinyl pyrene, polyvinyl perillene, polyacenaphthylene, polystyryl anthracene, polyvinyl carbazole, polyvinyl indole, and polyvinyl acridine, and copolymers of the vinyl compounds constituting the above-described vinyl polymers; vinyl ether polymers, such as polyanthryl methylvinyl ether, polypyrenyl methylvinyl ether, polycarbazolyl ethylvinyl ether, and polyindolyl ethylvinyl ether, and copolymers of the vinyl ether compounds constituting the above-described vinyl ether polymers; epoxy resins, such as polyglycidyl carbazole, polyglycidyl indole, and poly-p-glycidyl anthrylbenzene; homo- and copolymers of acrylic acid esters and methacrylic acid esters, for example, containing the above-described $\pi$-electron-containing nuclei as a substituent; and condensates of the above-described $\pi$-electron-containing compounds and formaldehyde.

Suitable polyvinyl carbazoles include poly-N-vinyl carbazole, poly-N-vinyl carbazole derivatives containing a substituent or substituents, e.g., an aryl group, an alkylaryl group, an amino group, an alkylamino group, a dialkylamino group, as arylamino group, a diarylamino group, a N-alkyl-N-arylamino group, a nitro group, and a halogen atom, on the carbazole ring (these compounds are hereinafter referred to as "poly-N-vinyl carbazole substituted derivatives"), and N-vinyl carbazole or substituted N-vinyl carbazole copolymers.

Exemplary N-vinyl carbazole copolymers which can be used are those copolymers containing at least 50 mol% of the N-ethylene carbazole constitutional repeating unit having the formula (III):

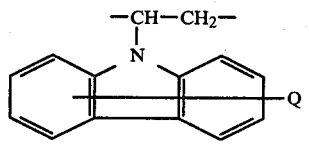

(III)

wherein Q is the same substituent as defined for the above-described poly-N-vinyl carbazole substituted derivatives. Preferred examples of other repeating units constituting N-vinyl carbazole copolymers are 1-phenylethylene, 1-cyanoethylene, 1-cyano-1-methylethylene, 1-chloroethylene, 1-(alkoxycarbonyl-)ethylene, and 1-alkoxycarbonyl-1-methylethylene, the repeating units being derived from styrene, acrylonitrile, methacrylonitrile, vinyl chloride alkyl acrylate, and alkyl methacrylate, respectively. The alkyl group of the alkoxy carbonyl group can be an alkyl group containing from 1 to 18 carbon atoms, including a methyl group, an ethyl group, a hexyl group, a dodecyl group, an octadecyl group, and a 4-methylcyclohexyl group. The terms "constitutional repeating unit" as used herein is the same as defined in *Kobunshi* (*Polymer Journal*), vol. 27, pp. 345–359 (1978) (Japanese version of *Pure and Applied Chemistry*, vol. 48, pp. 375–385 (1976)).

Of these polymeric organic photoconductive substances, poly-N-vinyl carbazole, poly-N-vinyl carbazole substituted derivatives containing the above-described substituents, and N-vinyl carbazole or substituted N-vinyl carbazole copolymers are most preferred.

(ii) Aromatic tertiary amino compounds

Triphenylamine, N,N-dibenzylaniline, diphenylbenzylamine, N,N-di(p-chlorobenzyl)aniline, di($\beta$-naphthyl)benzylamine, tri(p-tolyl)amine, and diphenylcyclohexylamine (iii) Aromatic tertiary diamino compounds N,N,N',N'-Tetrabenzyl-p-phenylenediamine, N,N,N',N'-tetra(p-chlorobenzyl)-p-phenylenediamine, N,N,N',N'-tetramethyl-p-phenylenediamine, N,N,N',N'-tetrabenzyl-m-phenylenediamine, N,N,N',N'-tetramethylbenzidine, N,N,N',N'-tetrabenzylbenzidine, N,N,N',N'-tetraphenyl-p-phenylenediamine, N,N,N',N'-tetraphenyl-m-phenylenediamine, 1,1-bis[4-(dibenzylamino)phenyl]ethane, 1,1-bis[4-(dibenzylamino)phenyl]propane, 1,1-bis[4-(dibenzylamino)-phenyl]butane, 1,1-bis[4-(dibenzylamino)phenyl]-2-methylpropane, 2,2-bis[4-(dibenzylamino)phenyl]propane, 2,2-bis[4-(dibenzylamino)phenyl]butane, 1,1-bis 4-[di(m-methylbenzylamino)phenyl]propane, bis[p-(dimethylamino)phenyl]phenylmethane, bis[p-(diethylamino)phenyl]phenylmethane, bis[4-(dibenzylamino)phenyl]methane, bis{4-[di(p-chlorobenzyl-)amino]phenyl}methane, 1,1-bis[p-(dimethylamino)-phenyl]-1-phenylethane, 4,4'-benzylidenebis(N,N-dimethyl-m-toluidine), 4',4''-bis(diethylamino)-2,6-dichloro-2',2''-dimethyltriphenylmethane, bis[4-(diethylamino)-2-methylphenyl]-$\alpha$-naphthylmethane, 4',4''-bis(dimethylamino)-2-chloro-2',2''-dimethyltriphenylmethane, 1,1-bis[p-(diethylamino)phenyl]-1-phenylethane, 1,1-diphenyl-5,5-bis[4-(diethylamino)-2-methylphenyl]-1,3-pentadiene, 1,1-diphenyl-3,3-bis[4-(diethylamino)-2-methylphenyl]-propane, bis[4-(dibenzylamino)phenyl]ether, bis[4-(diethylamino)-phenyl]ether, bis[4-(dibenzylamino)phenyl]sulfide, 2,2-bis[4-(di-p-tolylamino)phenyl]propane, 1,1-bis[4-(di-p-tolylamino)phenyl]-1-phenylethane, and bis[4-dibenzylamino)phenyl]diphenylmethane (iv) Aromatic tertiary triamino compounds Tris[4-(diethylamino)phenyl]methane, and 1,1-bis[4-(diethylamino)-2-methylphenyl]-1-[4-(dimethylamino)-phenyl]methane (v) Condensates Condensates of aldehydes and aromatic amines, such as a condensate of acetoaldehyde and α-naphthylamine, a condensate of formaldehyde and N-ethylaniline, condensates of tertiary aromatic amines, such as triphenylamine, and aromatic halides, and condensates of poly-p-phenylene-1,3,4-oxadiazole, formaldehyde, and condensed polycyclic aromatic compounds, such as 3,6-dimethyl carbazole.

(vi) Metal-containing compounds

2-Mercaptobenzothiazole lead salt, 2-mercaptobenzothiazole zinc salt, 2-mercaptobenzothiazole copper salt, 2-mercaptobenzoxazole lead salt, 2-mercapto-5-phenylbenzoxazole lead salt, 2-mercapto-6-methoxybenzoimidazole lead salt, 8-hydroxyquinoline magnesium salt, 8-hydroxyquinoline aluminum salt, 8-hydroxyquinoline lead salt, 7-benzyl-8-hydroxyquinoline copper salt, and 2-hydroxy-4-methylazobenzene copper salt, (vii) Heterocyclic compounds (a) Pyrazoline derivatives 1,3,5-Triphenylpyrazoline, 1-phenyl-3-[p-(dimethyl)-styryl]-5-[p-(dimethylamino)phenyl]pyrazoline, 1,5-diphenyl-3-styrylpyrazoline, 1,3-diphenyl-5-styrylpyrazoline, 1,3-diphenyl-5-[p-(dimethylamino)phenyl]-pyrazoline, and 1,3-diphenyl-5-(2-furyl)pyrazoline (b) 1,2,4-Triazine derivatives 3-[p-(dimethylamino)phenyl]-5,6-bis(p-dimethoxyphenyl)-1,2,4-triazine, 3-[p-(dimethylamino)phenyl]-5,6-di(2-pyridyl)-1,2,4-triazine, 3-[p-(dimethylamino)-phenyl]-5,6-di(p-ethoxyphenyl)-1,2,4-triazine, 3-[p-(diethylamino)phenyl]-5,6-bis(p-methoxyphenyl)-1,2,4-triazine, and 3-[p-(diethylamino)phenyl]-5,6-bis(p-ethoxyphenyl)-1,2,4-triazine (c) Quinazoline derivatives 2,4-Diphenylquinazoline, 2-phenyl-4-p-tolylquinazoline, 2 phenyl-4-[4-(dimethylamino)phenyl]quinazoline, 2-phenyl-4-styrylquinazoline, and 2,4-diphenylbenzo[h-]quinazoline (d) Benzofuran derivatives 6-Hydroxy-2-phenyl-3-[4-(dimethylamino)phenyl]-benzofuran, 6-hydroxy-2,3-di(4-methoxyphenyl)benzofuran, and 2,3,5,6-tetra(4-methoxyphenyl)benzo[1,2-b:5,4-b']difuran (e) Oxadiazole derivatives 2,5-Bis[4-(dimethylamino)phenyl]-1,3,4-oxadiazole, 2,5-bis[4-(diethylamino)phenyl]-1,3,4-oxadiazole, and 2,5-bis[4-(isoamylamino)phenyl]-1,3,4-oxadiazole All the compounds represented by the general formula (I) or (II) can be synthesized by the method described in *Beilsteins Handbuch der Organischen Chemie,* vol. 10, page 149.

The alkyl or alkoxy group indicated by X in the general formulae (I) and (II) can be a straight or branched alkyl or alkoxy group containing from 1 to 22 carbon atoms.

Substituents for substituted alkyl and alkoxy groups indicated by X in the general formulae (I) and (II) include a halogen atom, e.g., a chlorine atom, a bromine atom, and a fluorine atom, a cyano group, a nitro group, a phenyl group, and a tolyl group. Thus, the substituted alkyl or alkoxy group, can be a straight or branched alkyl or alkoxy group containing from 1 to 22 carbon atoms and with from 1 to 3 substituents as described above bound thereto.

The aryl or aryloxy group represented by X may be monocyclic or bicyclic (of the two-ring condensed type). Typical examples include a phenyl group, a naphthyl group, a phenoxy group, and a naphthyloxy group.

Substituents for the substituted aryl and aryloxy groups include a halogen atom, e.g., a chlorine atom, a bromine atom, and a fluorine atom, a cyano group, a nitro group, a straight or branched alkyl group containing from 1 to 5 carbon atoms, a straight or branched alkoxy group containing from 1 to 5 carbon atoms, an alkoxycarbonyl group containing a straight or branched alkyl group having from 1 to 5 carbon atoms, and a phenyl or naphthyl group containing from 1 to 3 acyl groups, with the acyl group containing a straight or branched alkyl group having from 1 to 5 carbon atoms.

The compounds of the general formula (I) or (II) as used herein have great advantages in that they increase the light sensitivities of organic photoconductive substances, they have good compatibility with organic photoconductive substances, particularly poly-N-vinyl carbazole, poly-N-vinyl carbazole substituted derivatives, and copolymers of N-vinyl carbazole or substituted N-vinyl carbazoles, and they produce electrophotographic light-sensitive layers (photoconductive composition layers) of electrophotographic light-sensitive materials, having good film properties (e.g., films are uniform, tough, and flexible, and have a great adhesivity to supports).

Typical examples of the compounds represented by the general formula (I) include ethyl p-hydroxybenzoate, ethyl m-hydroxybenzoate, ethyl o-hydroxybenzoate, methyl p-hydroxybenzoate, butyl p-hydroxybenzoate, propyl p-hydroxybenzoate, phenyl p-hydroxybenzoate, naphthyl p-hydroxybenzoate, chloroethyl p-hydroxybenzoate, p-tolyl p-hydroxybenzoate, p-ethylphenyl p-hydroxybenzoate, diethyl 2-hydroxyterephthalate, diethyl 2-hydroxyisophthalate, ethyl 2,4-dihydroxybenzoate, 4-acetylphenol, p-hydroxybenzophenone, and p-hydroxyphenyl ethyl ketone.

Typical examples of the compounds represented by the general formula (II) include 5-ethoxycarbonyl-1-naphthol, 3-ethoxycarbonyl-1-naphthol, 5-methoxycarbonyl-1-naphthol, 5-butoxycarbonyl-1-naphthol, 5-propoxycarbonyl-1-naphthol, 5-phenoxycarbonyl-1-naphthol, 4-ethoxycarbonyl-2-naphthol, 6-ethoxycarbonyl-2-naphthol, 5-acetyl-1-naphthol, 5-propionyl-1-naphthol, 5-benzoyl-1-naphthol, 4-acetyl-2-naphthol, and 4-benzoyl-2-naphthol.

In the invention, the sensitivity of photoconductive compositions comprising organic photoconductive substances and compounds of the general formula (I) or (II) can be further increased by adding thereto sensitizing dyes capable of increasing the sensitivity of the organic photoconductive substances.

For this purpose, known sensitizing dyes which are used in the dye-sensitization of organic photoconductive substances can be used. Typical examples of such sensitizing dyes are described in *Society of Photographic Scientists and Engineers,* 19, 60–64 (1975), *Applied Optics,*

Suppl., 3, 50 (1969), U.S. Pat. Nos. 3,037,861, 3,250,615, 3,712,811, British Pat. No. 1,353,264, *Research Disclosure*, #10938 (109, May 1973, page 62), U.S. Pat. Nos. 3,141,700, 3,938,994, Japanese Patent Application (OPI) Nos. 14560/81, 14561/81, 29586/81, 29587/81, 65885/81 (the term "OPI" is used herein to mean a "published unexamined Japanese Patent Application"), Japanese Patent Applicaton No. 114259/80, and Japanese Patent Application (OPI) No. 35141/81.

From these known sensitizing dyes and other dyes capable of increasing the sensitivity of polymeric organic photoconductive substances, any suitable dye can be selected and used.

Suitable examples of the above-described sensitizing dyes are given below:

Triphenylmethane Dyes, such as Brilliant Green, Victoria Blue B, Methyl Violet, Crystal Violet, and Acid violet 6B; Rhodamines, such as Rhodamine B, Rhodamine 6G, Rhodamine G Extra, Sulfo Rhodamine B, and Fast Acid Eosine G: xanthene dyes, such as Eosine S, Eosine A, Erythrosine, Phloxine, Rose Bengale, and Fluorescein; thiazine dyes, such as Methylene Blue; acridine dyes, such as Acridine Yellow, Acridine Orange, and Trypaflavin; quinoline dyes, such as pinacyanol, and cryptocyanine; quinone and ketone dyes, such as Alizarine, Alizarine Red S, and quinizarin; cyanine dyes; chlorophyll; arylmethane dyes, such as Violet Fuchsine, Erythrosine 2Na, Rhodamine B 500, Fanal Pink B, Rhodamine 6 GDN, and Auramine; polymethine dyes, such as 3,3-diethyl.thiacarbocyanine iodide; azo dyes such as Eriochrome Blue-Black R; azomethine dyes, such as bis(p-dimethylaminobenzal)azine; carbonyl dyes, such as Solway Ultra Blue B, and Alizarine Cyanin Green GWA; heterocyclic compounds, such as N,N-pentamethylenebis(benzthiazole) perchlorate; phthalocyanine dyes, such as Segnale, Light, Turquoise NB; and pyrylium dyes, such as 2,6-di-tert-butyl-4-(2,6-di-tert-butyl-4H-thiopyran-4-indenemethyl)-thiapyrylium salt, 2,6-di-tert-butyl-4-[(2,6-di-tert-butyl-4H-thiapyran-4-indene)propen-1-yl]thiapyrylium salt, 2,6-diphenyl-4-(4-diethylaminophenyl)thiapyrylium salt, and 2,6-di-tert-butyl-4-(4-diethylaminostyryl)-thiapyrylium salt.

These sensitizing dyes are added in amounts sufficient to sensitize organic photoconductive substances, and therefore, the amount of sensitizing dye added varies with the types of organic photoconductive substance and sensitizing dye. In general, sensitizing dyes can be added in an amount ranging between about 0.01 and 100 parts by weight, preferably between about 0.1 and 30 parts by weight, per 100 parts by weight of organic photoconductive substance.

The photoconductive composition of the invention may contain, if necessary, known structure agents, improving film strength plasticizers, dyes, pigments, etc., within the ranges not deteriorating the composition characteristics.

Structure agents which can be used include cyanoethyl cellulose, nitrile rubber, polycarbonate of bisphenol A, linear polyesters, styrene-butadiene copolymers, and vinylidene-acrylonitrile copolymers. Plasticizers which can be used include chlorinated biphenyls, epoxy resins, triphenylmethane compounds, cumarone resins, and low molecular weight xylene resins.

In preparing the photoconductive composition of the invention, the above-described two or more components, and ingredients which are to be added, if present, are dispersed or dissolved in a desired ratio to prepare a dispersion or uniform solution, the dispersion or uniform solution is coated on a suitable support, and the common solvent is removed, for example, by vaporization. Depending on the purpose for which the photoconductive composition is used, the dispersion or uniform solution may be used as such without completely removing the solvent. The thus-prepared photoconductive composition solution is coated on a suitable support having an electrically conductive surface and dried to form a photoconductive layer. Depending on the use, an adhesive layer and so forth may be employed.

Suitable solvents or dispersants which can be used in the preparation of coating solutions include benzene, toluene, xylene, chlorobenzene, dichlorobenzene, dichloroethane, trichloroethane, cyclohexanone, tetrahydrofuran, dioxane, etc., and mixtures thereof, those solvents capable of dissolving or dispersing therein polymeric organic photoconductive substances, sensitizing dyes, compound represented by the general formula (I) or (II), and additives to be added, if present, can be used.

The proportion of the compound represented by the general formula (I) or (II) in the photoconductive composition is determined in relation to the amount of the organic photoconductive substance contributing to photoconductive insulativity. The amount of the compound represented by the general formula (I) or (II) used is from about 0.1 to 100 parts by weight, and preferably from 0.5 to 30 parts by weight, per 100 parts by weight of the organic photoconductive substance. Addition of the compound of the general formula (I) or (II) above or below the above-specified limits results in a reduction in sensitivity of the resulting photoconductive composition and an increase in residual potential.

For supports with an electrically conductive surface, it is sufficient that at least the surface is electrically conductive. In more detail, drums and sheets made of metals, such as aluminum, copper, iron, and zinc, and paper, plastics, glass, etc., whose surface has been rendered electrically conductive by, for example, vacuum-depositing metals, such as aluminum, copper, zinc, and indium, vacuum-depositing electrically conductive metallic compounds, such as $In_2O_3$ and $SnO_2$, laminating a metallic foil, and dispersing carbon black, an electrically conductive metallic compound (e.g., $In_2O_3$ and $SnO_2$) powder, metallic powder, or the like in binder polymers and coating the resulting dispersions, can be used.

Addition of the compounds represented by the general formula (I) or (II) to organic photoconductive substances permits production of electrophotographic light-sensitive films which are highly sensitized and are stable with time.

It is also possible for the photoconductive composition of the invention to be ground to fine particles, dispersed in insulating solvents, and processed by an electrophoresis image-forming photographic process described in, for example, U.S. Pat. Nos. 3,384,565 (corresponding to Japanese Patent Publication No. 21781/68), 3,384,488 (corresponding to Japanese Patent Publication No. 37125/72), and 3,510,419 (corresponding to Japanese Patent Publication No. 36079/71), to form images.

The following examples are given to illustrate the invention in greater detail. Unless otherwise indicated herein all parts, percents, ratios and the like are by weight.

EXAMPLE 1

One gram of poly-N-vinyl carbazole (PVCz) was dissolved in 20 ml of 1,2-dichlorethane, and 25 mg of 2,6-di-tert-butyl-4-[4-(N-methyl-N-2-cyanoethylamino)styryl]thiapyrylium tetrafluoroborate was added to the resulting solution.

The thus-prepared solution was coated on a 100 μm thick polyethylene terephthalate (PET) film having a 60 nm thick $In_2O_3$ vacuum-deposited layer thereon (i.e., PET film made electrically conductive with $In_2O_3$), and then, dried to remove the solvent, forming a 5 μm thick photoconductive layer (an electrophotographic light-sensitive layer). In this way, Electrophotographic Film No. 1 (comparative example) was prepared.

To a portion of the above-prepared solution were added the compounds represented by the general formula (I) or (II) as shown in Table 1 below in the amount also shown in Table 1 (per 100 parts by weight of PVCz) to prepare a series of solutions. Each solution was coated on the same PET film made electrically conductive with $In_2O_3$ as above and dried to remove the solvent, forming a 5 μm thick photoconductive layer. In this way, Electrophotographic Films Nos. 2 to 15 were prepared (examples of this invention). The sensitivity of the photoconductive layer was measured for the thus-prepared Electrophotographic Films Nos. 1 to 15 i.e., the exposure amount (E50) at which the initial potential (500 V) was reduced to one-half (½) by attenuation, and the exposure amount (E90) at which the initial potential (500 V) was reduced to one-tenth (1/10) were measured. The results are shown in Table 1 below. As a light sourse, a 630 nm monochromatic light was used.

TABLE 1

| Electrophotographic Film No. | Compound Represented by General Formula (I) or (II) | Amount (parts by weight | $E_{50}$ (erg/cm$^2$) | $E_{90}$ (erg/cm$^2$) |
|---|---|---|---|---|
| 1 (comparative example) | — | — | 65 | 430 |
| 2 | 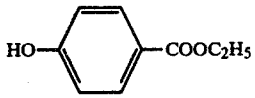 | 1 | 48 | 311 |
| 3 | | 5 | 36 | 218 |
| 4 | 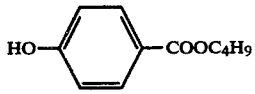 | 1 | 50 | 310 |
| 5 | | 5 | 35 | 214 |
| 6 | 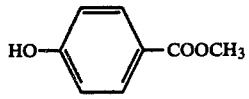 | 1 | 47 | 298 |
| 7 | | 5 | 35 | 210 |
| 8 | 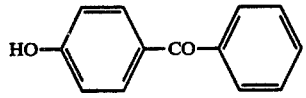 | 1 | 55 | 340 |
| 9 | | 5 | 40 | 230 |
| 10 | 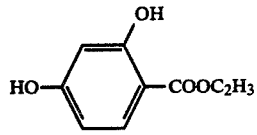 | 1 | 50 | 310 |
| 11 | | 5 | 38 | 226 |
| 12 | 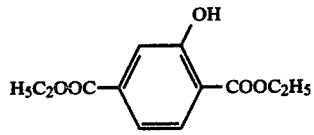 | 1 | 47 | 300 |
| 13 | | 5 | 35 | 210 |
| 14 | 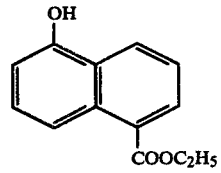 | 1 | 52 | 320 |
| 15 | | 5 | 37 | 220 |

EXAMPLE 2

Electrophotographic Films Nos. 16 (comparative example), 17 and 18 (examples of this invention), 19 (comparative example), and 20 and 21 (examples of this invention) were prepared in the same manner as in the preparation of the Electrophotographic Films Nos. 1 and 2 in Example 1 except that 25 mg of 2,6-di-tert-butyl-4-[4-(N,N-dichloroethylaminostyryl]-thiapyrylium tetrafluoroborate and 25 mg of Rhodamine B (C.I. #45170) were used in place of 25 mg of 2,6-di-tert-butyl-4-[4-(N-methyl-N-2-cyanoethylaminostyryl]thiapyrylium tetrafluoroborate. The sensitivity of these electrophotographic films was measured using the same method as in Example 1. The results are shown in Table 2 below.

EXAMPLE 3

Electrophotographic Films Nos. 22 (comparative example), and 23 and 24 (examples of this invention) were prepared in the same manner as in the preparation of the Electrophotographic Films Nos. 1 and 2 in Example 1 except that a PET film having a $SnO_2$ fine powder/gelatin layer, prepared by the method described in Examples 1 and 2 of Japanese Patent Application No. 47665/80, was used in place of the PET film rendered electrically conductive with $In_2O_3$. The sensitivity of these electrophotographic films was measured using the same method as in Example 1. The results are shown in Table 2 below.

TABLE 2

| Electrophotographic Film No. | Sensitizing Dye | Compound Represented by General Formula (I) or (II) | Amount (parts by weight) | $E_{50}$ (erg/cm$^2$) | $E_{90}$ (erg/cm$^2$) |
|---|---|---|---|---|---|
| 16 (comparative example) | 2,6-di-tert-butyl-4-[4-N,N—dichloroethylamino)styryl]thiaphyrylium tetrafluoroborate | | — | 60 | 412 |
| 17 | " | 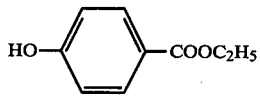 | 1 | 47 | 308 |
| 18 | " | " | 5 | 34 | 200 |
| 19 (comparative example) | Rhodamine B | — | — | 140 | 1020 |
| 20 | " | 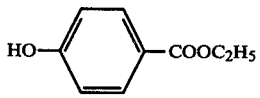 | 1 | 84 | 680 |
| 21 | " | " | 5 | 70 | 520 |
| 22 (comparative example) | Same as in No. 1 | — | — | 66 | 441 |
| 23 | " | 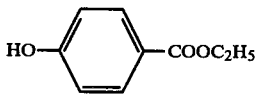 | 1 | 48 | 310 |
| 24 | " | " | 5 | 36 | 212 |

EXAMPLE 4

Electrophotographic Films Nos. 3, 5, 7, 9, and 11 were allowed to stand in an air-controlled container at temperature 45° C. and humidity 75% for one month. At the end of that time, their sensitivities were measured. It was found that there was no change in sensitivity even after they were allowed to stand for one month.

While the invention has been described in detail and with reference to specific embodiments thereof, it will be apparent to one skilled in the art that various changes and modifications can be made therein without departing from the spirit and scope thereof.

What is claimed is:

1. An electrophotoconductive composition comprising an organic photoconductive substance and at least one compound represented by the general formula (I) or (II):

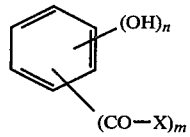

(I)

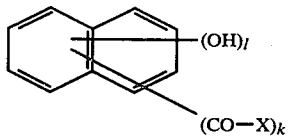

(II)

wherein X is an alkyl group, a substituted alkyl group, an aryl group, a substituted aryl group, an alkoxyl group, a substituted alkoxyl group, an aryloxyl group, or a substituted aryloxyl group, n and m each represent an integer of 1 or 2, and l and k each represent an integer from 1 to 4.

2. The electrophotoconductive composition as claimed in claim 1, further comprising a sensitizing dye capable of increasing the sensitivity of the organic photoconductive substance.

3. An electrophotographic light-sensitive material comprising a support having an electrically conductive surface and a photoconductive composition layer as claimed in claim 1 on the support.

4. An electrophotographic light-sensitive material comprising a support having an electrically conductive surface, and a photoconductive composition layer as claimed in claim 2 on the support.

5. The electrophotoconductive composition as claimed in claim 1, wherein said organic photoconductive substance is a polymeric organic photoconductive substance comprising the polymerization product of polycyclic aromatic or heterocyclic vinyl compounds containing $\pi$-electrons, an aromatic tertiary amino compound, an aromatic tertiary diamino compound, an aromatic tertiary triamino compound, a condensate of an aldehyde and an aromatic amine, a condensate of a tertiary aromatic amine and an aromatic halide, a condensate of poly-p-phenylene-1,3,4-oxadiazole formaldehyde and, a condensed polycyclic aromatic compound, a metal-containing compound, or a heterocyclic compound.

6. The electrophotoconductive composition as claimed in claim 1, wherein the substituents for the substituted alkyl and alkoxy group represented by X in the general formula (I) and (II) are a halogen atom, a cyano group, a nitro group, a phenyl group, or a tolyl group and wherein the substituted alkyl or alkoxy group comprises a straight or branched chain alkyl or alkoxy group containing from 1 to 22 carbon atoms and with from 1 to 3 substituents as set forth above bound thereto; said aryl or aryloxy group represented by X in the general formula (I) and (II) is a monocyclic or bicyclic aryl or aryloxy group; said substituents for the substituted aryl or aryloxy group are a halogen atom, a cyano group, a nitro group, a straight or branched chain alkyl group containing from 1 to 5 carbon atoms, a straight or branched chain alkoxy group containing from 1 to 5 carbon atoms, an alkoxycarbonyl group containing a straight or branched chain alkyl group having from 1 to 5 carbon atoms, or a phenyl or naphthyl group containing from 1 to 3 acyl groups, each acyl group containing a straight or branched chain alkyl moiety having from 1 to 5 carbon atoms therein.

7. The electrophotoconductive composition as claimed in claim 1, wherein said compound of the general formula (I) is ethyl p-hydroxybenzoate, ethyl m-hydroxybenzoate, ethyl o-hydroxybenzoate, methyl p-hydroxybenzoate, butyl p-hydroxybenzoate, propyl p-hydroxybenzoate, phenyl p-hydroxybenzoate, naphthyl p-hydroxybenzoate, chloroethyl p-hydroxybenzoate, p-tolyl p-hydroxybenzoate, p-ethylphenyl p-hydroxybenzoate, diethyl 2-hydroxyterephthalate, diethyl 2-hydroxyisophthalate, ethyl 2,4-dihydroxybenzoate, 4-acetylphenol, p-hydrobenzophenone or p-hydroxyphenyl ethyl ketone and said compound of the general formula (II) is 5-ethoxycarbonyl-1-naphthol, 3-ethoxycarbonyl-1-naphthol, 5-methoxycarbonyl-1-napthol, 5-butoxycarbonyl-1-naphthol, 5-propoxycarbonyl-1-naphthol, 5-phenoxycarbonyl-1-naphthol, 4-ethoxycarbonyl-2-naphthol, 6-ethoxycarbonyl-2-naphthol, 5-acetyl-1-naphthol, 5-propionyl-1-naphthol, 5-benzoyl-1-naphthol, 4-acetyl-2-naphthol or 4-benzoyl-2-naphthol.

8. The electrophotoconductive composition as claimed in claim 2, wherein said organic photoconductive substance is a polymeric organic photoconductive substance comprising the polymerization product of polycyclic aromatic or heterocyclic vinyl compounds containing $\pi$-electrons, an aromatic tertiary amino compound, an aromatic tertiary diamino compound, an aromatic tertiary triamino compound, a condensate of an aldehyde and an aromatic amine, a condensate of a tertiary aromatic amine and an aromatic halide, a condensate of poly-p-phenylene-1,3,4-oxaidazole and formaldehyde, a condensed polycyclic aromatic compound, a metal-containing compound, or a heterocyclic compound.

9. The electrophotoconductive composition as claimed in claim 2, wherein the substituents for the substituted alkyl and alkoxy group represented by X in the general formula (I) and (II) are a halogen atom, a cyano group, a nitro group, a phenyl group, or a tolyl group and wherein the substituted alkyl or alkoxy group comprises a straight or branched chain alkyl or alkoxy group containing from 1 to 22 carbon atoms and with from 1 to 3 substituents as set forth above bound thereto; said aryl or aryloxy group represented by X in the general formula (I) and (II) is a monocyclic or bicyclic aryl or aryloxy group; and substituents for the substituted aryl or aryloxy group are a halogen atom, a cyano group, a nitro group, a straight or branched chain alkyl group containing from 1 to 5 carbon atoms, a straight or branched chain alkoxy group containing from 1 to 5 carbon atoms, an alkoxycarbonyl group containing a straight or branched chain alkyl group having from 1 to 5 carbon atoms, or a phenyl or naphthyl group containing from 1 to 3 acyl groups, each acyl group containing a straight or branched chain alkyl moiety having from 1 to 5 carbon atoms therein.

10. The electrophotoconductive composition as claimed in claim 2, wherein said compound of the general formula (I) is ethyl p-hydroxybenzoate, ethyl m-hydroxybenzoate ethyl o-hydroxybenzoate, methyl p-hydroxybenzoate, butyl p-hydroxybenzoate, propyl p-hydroxybenzoate, phenyl p-hydroxybenzoate, naphthyl p-hydroxybenzoate, chloroethyl p-hydroxybenzoate, p-tolyl p-hydroxybenzoate, p-ethylphenyl p-hydroxybenzoate, diethyl 2-hydroxyterephthalate, diethyl 2-hydroxyisophthalate, ethyl 2,4-dihydroxybenzoate, 4-acetylpheonl, p-hydrobenzophenone or p-hydroxyphenyl ethyl ketone and said compound represented by the general formula (II) is 5-ethoxycarbonyl-1-naphthol, 3-ethoxycarbonyl-1-naphthol, 5-methoxycarbonyl-1-naphthol, 5-butoxycarbonyl-1-naphthol, 5-propoxycarbonyl-1-naphthol, 5-phenoxycarbonyl-1-naphthol, 4-ethoxycarbonyl-2-naphthol, 6-ethoxycarbonyl-2-naphthol, 5-acetyl-1-naphthol, 5-propionyl-1-naphthol, 5-benzoyl-1-naphthol, 4-acetyl-2-naphthol or 4-benzoyl-2-naphthol.

11. The electrophotoconductive composition as claimed in claim 2, wherein said sensitizing dye is a triphenylmethane dye, a rhodamine dye, a xanthene dye, a thiazine dye, an acridine dye, a quninoline dye, a quinone and keone dye, a cyanine dye, chlorophyll, an arylmethane dye, a polymethine dye, an azo dye, an azomethine dye, a carbonyl dye, a heterocyclic compound dye, a phthalocyanine dye, or a pyriylium dye.

12. The electrophotographic light-sensitive material as claimed in claim 3, wherein said organic photoconductive substance is a polymeric organic photoconductive substance comprising the polymerization product of polycyclic aromatic or heterocyclic vinyl compounds containing $\pi$-electrons, an aromatic tertiary amino compound, an aromatic tertiary diamino compound, an aromatic tertiary triamino compound, a condensate of an aldehyde and an aromatic amine, a condensate of a tertiary aromatic amine and an aromatic halide, a condensate of poly-p-phenylene-1,3,4-oxadiazole formaldehyde, and a condensed polycyclic aromatic compound, a metal-containing compound, or a heterocyclic compound.

13. The electrophotographic light-sensitive material as claimed in claim 3, wherein the substituents for the substituted alkyl and alkoxy group represented by X in the general formula (I) and (II) are a halogen atom, a cyano group, a nitro group, a phenyl group, or a tolyl group and wherein the substituted alkyl or alkoxy group comprises a straight or branched chain alkyl or alkoxy group containing from 1 to 22 carbon atoms and with from 1 to 3 substituents as set forth above bound thereto; said aryl or aryloxy group represented by X in the general formula (I) and (II) is a monocyclic or bicyclic aryl or aryloxy group; said substituents for the substituted aryl or aryloxy group are a halogen atom, a cyano group, a nitro group, a straight or branched chain alkyl group containing from 1 to 5 carbon atoms, a straight or branched chain alkoxy group containing from 1 to 5 carbon atoms, an alkoxycarbonyl group containing a straight or branched chain alkyl group having from 1 to 5 carbon atoms, or a phenyl or naphthyl group containing from 1 to 3 acyl groups, each acyl group containing a straight or branched chain alkyl moiety having from 1 to 5 carbon atoms therein.

14. The electrophotographic light-sensitive material as claimed in claim 3, wherein said compound of the general formula (I) is ethyl p-hydroxybenzoate, ethyl m-hydroxybenzoate, ethyl o-hydroxybenzoate, methyl p-hydroxybenzoate, butyl p-hydroxybenzoate, propyl p-hydroxybenzoate, phenyl p-hydroxybenzoate, naphthyl p-hydroxybenzoate, chloroethyl p-hydroxybenzoate, p-tolyl p-hydroxybenzoate, p-ethylphenyl p-hydroxybenzoate, diethyl 2-hydroxyterephthalate, diethyl 2-hydroxyisophthalate, ethyl 2,4-dihydroxybenzoate, 4-acetylphenol, p-hydrobenzophenone or p-hydroxyphenyl ethyl ketone and said compound the general formula (II) is 5-ethoxycarbonyl-1-naphthol, 3-ethoxycarbonyl-1-naphthol, 5-methoxycarbonyl-1-naphthol, 5-butoxycarbonyl-1-naphthol, 5-propoxycarbonyl-1-naphthol, 5-phenoxycarbonyl-1-naphthol, 4-ethoxycarbonyl-2-naphthol, 6-ethoxycarbonyl-2-naphthol, 5-acetyl-1-naphthol, 5-propionyl-1-naphthol, 5-benzolyl-1-naphthol, 4-acetyl-2-naphthol or 4-benzoyl-2-naphthol.

15. The electrophotographic light-sensitive material as claimed in claim 4, wherein said organic photoconductive substance is a polymeric organic photoconductive substance comprising the polymerization product of polycyclic aromatic or heterocyclic vinyl compounds containing $\pi$-electrons, an aromatic tertiary amino compound, an aromatic tertiary diamino compound, an aromatic tertiary triamino compound, a condensate of an aldehyde and an aromatic amine, a condensate of a tertiary aromatic amine and an aromatic halide, a condensate of poly-p-phenylene-1,3,4-oxidiazole formaldehyde and, a condensed polycyclic aromatic compound, a metal-containing compound, or a heterocyclic compound.

16. The electrophotographic light-sensitive material as claimed in claim 4, wherein the substituents for the substituted alkyl and alkoxy group represented by X in the general formula (I) and (II) are a halogen atom, a cyano group, a nitro group, a phenyl group, or a tolyl group and wherein the substituted alkyl or alkoxy group comprises a straight or branched chain alkyl or alkoxy group containing from 1 to 22 carbon atoms and with from 1 to 3 substituents as set forth above bound thereto; said aryl or aryloxy group represented X in the general formula (I) and (II) is a monocyclic or bicyclic aryl or aryloxy group; said substituents for the substituted aryl or aryloxy group are a hologen atom, a cyano group, a nitro group, a straight or branched chain and alkyl group containing from 1 to 5 carbon atoms, a straight or branched chain alkoxy group containing from 1 to 5 carbon atoms, an alkoxycarbonyl group containing a straight or branched chain alkyl group having from 1 to 5 carbon atoms, or a phenyl or naphthyl group containing from 1 to 3 acyl groups, each acyl group containing a straight or branched chain alkyl moiety having from 1 to 5 carbon atoms therein.

17. The electrophotographic light-sensitive material as claimed in claim 4, wherein said compound of the general formula (I) is ethyl p-hydroxybenzoate, ethyl m-hydroxybenzoate, ethyl o-hydroxybenzoate, methyl p-hydroxybenzoate, butyl p-hydroxybenzoate, propyl p-hydroxybenzoate, phenyl p-hydroxybenzoate, naphthyl p-hydroxybenzoate, chloroethyl p-hydroxybenzoate, p-tolyl p-hydroxybenzoate, p-ethylphenyl p-hydroxybenzoate, diethyl 2-hydroxyterephthalate, diethyl 2-hydroxyisophthalate, ethyl 2,4-dihydroxybenzoate, 4-acetylphenol, p-hydrobenzophenone or p-hydroxyphenyl ethyl ketone and said compound of the general formula (II) is 5-ethoxycarbonyl-1-naphthol, 3-ethoxycarbonyl 1-naphthol, 5-methoxycarbonyl-1-naphthol, 5-butoxycarbonyl-1-naphthol, 5-propoxycarbonyl-1-naphthol, 5-phenoxycarbonyl-1-naphthol, 4-ethoxycarbonyl-2-naphthol, 6-ethoxycarbonyl-2-naphthol, 5-acetyl-1-naphthol, 5-propionyl-1-naphthol, 5-benzoyl-1-naphthol, 4-acetyl-2-naphthol or 4-benzoyl-2-naphthol.

18. The electrophotographic light-sensitive material as claimed in claim 4, wherein said sensitizing dye is a triphenylmethane dye, a rhodamine dye, a xanthene dye, a thiazine dye, an acridine dye, a quinoline dye, a quinone and ketone dye, a cyanine dye, chlorophyll, an arylmethane dye, a polymethine dye, an azo dye, an azomethine dye, a carbonyl dye, a heterocyclic compound dye, a phthalocyanine dye, or a pyriylium dye.

19. The electrophotographic light-sensitive material as claimed in claim 3, wherein said support is or has a surface of a metal or a paper, plastic or glass whose surface has been rendered electrically conductive.

* * * * *